US007300006B2

(12) United States Patent
Weisbeck

(10) Patent No.: US 7,300,006 B2
(45) Date of Patent: Nov. 27, 2007

(54) PORTABLE PILL CRUSHER

(75) Inventor: Richard Weisbeck, Kelowna (CA)

(73) Assignee: Manrex Limited, Winnipeg, Manitoba (CA)

( * ) Notice: Subject to any disclaimer, the term of this patent is extended or adjusted under 35 U.S.C. 154(b) by 147 days.

(21) Appl. No.: 11/202,359

(22) Filed: Aug. 12, 2005

(65) Prior Publication Data

US 2006/0043224 A1 Mar. 2, 2006

Related U.S. Application Data

(60) Provisional application No. 60/604,005, filed on Aug. 25, 2004.

(51) Int. Cl.

| | |
|---|---|
| ***B02C 7/14*** | (2006.01) |
| ***B02C 9/04*** | (2006.01) |
| ***B02C 11/08*** | (2006.01) |
| ***B02C 23/00*** | (2006.01) |

(52) U.S. Cl. ..... 241/63; 241/DIG. 27; 100/244; 100/264

(58) Field of Classification Search ..... 241/DIG. 27, 241/63; 100/244, 264

See application file for complete search history.

(56) References Cited

U.S. PATENT DOCUMENTS

| | | | | |
|---|---|---|---|---|
| 2,707,503 | A * | 5/1955 | Johnson et al. | 99/578 |
| 3,996,849 | A * | 12/1976 | Del Jiacco | 100/218 |
| 5,001,974 | A * | 3/1991 | Gombos | 100/4 |
| 5,067,666 | A | 11/1991 | Sussman | |
| 5,531,386 | A | 7/1996 | Jensen | |
| 5,694,742 | A * | 12/1997 | Elliott et al. | 53/436 |
| 6,523,766 | B1 | 2/2003 | Watt | |
| 6,622,949 | B1 | 9/2003 | Baswick et al. | |
| 2005/0127218 | A1 | 6/2005 | Demske et al. | |

* cited by examiner

*Primary Examiner*—Bena Miller
(74) *Attorney, Agent, or Firm*—Adrian D. Battison; Michael R. Williams; Ryan W. Dupuis

(57) ABSTRACT

A pill crusher has a portable housing with a base to be supported on a surface and a top surface having a transverse slot opening into a holding container in the housing for one of more pills carried in a pouch. The pouch can be manually inserted through the slot until a bottom edge of the pouch sits on a base of the container. Two horizontally oriented and opposed solenoids are powered by rechargeable battery power in the housing and drive vertical crusher plates toward one another in the holding container to impact repeatedly, during depression by the operator of a manual switch, until the operator determines that the repeated impacting action has sufficiently crushed the pills in the pouch so that the pouch can be withdrawn through the top opening.

22 Claims, 7 Drawing Sheets

PORTABLE PILL CRUSHER

This application claims benefit under 35USC119 of the filing date of Provisional Application Ser. No. 60/604005 filed Aug. 25$^{th}$ 2004

FIELD OF THE INVENTION

The present invention relates generally to the field of mechanical crushing devices, and more particularly, it relates to a mechanical pill crusher.

BACKGROUND OF THE INVENTION

As research and development in modern medicine advances, new cures and treatments are being discovered to treat patients with various diseases and illnesses. In response to such discoveries, pharmaceutical companies need to produce a plurality of medications and prescription drugs, many of which are provided in pill or tablet form, for health practitioners to prescribe and administer to patients. Unfortunately, many patients, such as geriatric patients, younger children, and comatose or physically impaired patients, have difficulties with or are incapable of swallowing a pill.

Typically, a health care provider will crush or pulverize a pill into powder form, using a mortar and pestle, so that the predication may be mixed with food or dissolved in a liquid. Although effective, the use of a mortar and pestle is very tiresome and time consuming as it requires repeated crushing and pounding. Furthermore, airborne particles of the medication may be released during the pulverizing process. Also, once the pill bas been pulverized into powder form, some of the medication may be left in the mortar when it is transferred out to administer to the patient. Not only is there a chance that the patient may not receive a full dose, but there also exists the possibility of cross-contamination when the mortar and pestle is used to pulverize another type of pill.

There are numerous pill crushing devices available in the art, including manual, spring-loaded, and motor driven devices.

U.S. Pat. No. 6,622,949 to Baswick et al issued Sep. 23, 2003 describes a portable solenoid driven medicine crushing apparatus comprising a solenoid mounted within an enclosure wherein the solenoid engages a crushing ram in an attitude for moving vertically downward when the solenoid is energized. The crushing ram is released from a return spring when the solenoid is energized and the crushing ram engages a cup assembly to crush the medicine sandwiched between an inner cup and an outer cup of the cup assembly.

U.S. Pat. No. 5,067,666 to Sussman issued Nov. 26, 1991 discloses a portable pill crusher similar to that of Baswick in which a cup is inserted underneath a ram where the ram is actuated by a cam drive arrangement to force the ram downwardly onto the pills within the cup.

U.S. Pat. No. 6,523,766 to Watt issued Feb. 25, 2003 discloses a portable pill crushing device which has a slot in an upper surface into which pills can be dropped. A bag feeding device feeds bags from a supply so that the pills are dropped into the bag and the bag closed by a closing member. A horizontally actuated ram acts to impact on the pills in the bag while the bag is held by the closure member. The bag containing the crushed pills is then dispensed through a bottom opening in the housing.

U.S. Pat. No. 5,531,386 to Jensen issued Jul. 2, 1996 discloses a pill crusher in which pills in a pouch are inserted through an opening in a top surface into a container in the housing and the pills are crushed by a spring actuated ram which is released from a latch and driven by the spring to provide sufficient impact to pulverize the pills in one stroke.

U.S. patent application No. 2005/0127218 to Demske published Jun. 16, 2005 discloses a portable pill crushing device which uses rollers through which the pouch containing the pills passes for crushing between the nips of the rollers.

Other devices are provided in various arrangements shown in a number of prior patents which use mechanical crushing arrangements driven by a hand operated lever. These have the advantage of being inexpensive and simple but have the significant disadvantage that they require a lever action by the operator which can cause stress related injuries.

SUMMARY OF THE INVENTION

It is an object of the present invention to provide a portable power actuated pill crusher.

According to a first aspect of the invention there is provided a pill crusher comprising:

a housing;

a holding container in the housing for one of more pills carried in a pouch;

an aperture in the housing allowing access into the holding container for insertion of the pouch containing the pills into the holding container;

a first and a second solenoid mounted within the housing;

each solenoid including a plunger carrying a crusher member;

a power source mounted within the housing and a switch actuable by a user for supplying power to the solenoids;

the solenoids being mounted in the housing in opposition so as to move the crusher members toward one another into impact;

the crusher members being arranged at the holding container so as to move into impact within the holding container and the crusher members having cooperating surfaces arranged to crush the pills in the pouch.

The crusher members are preferably plates in the sense that they have flat cooperating crushing surfaces, but they may be manufactures as an integral part of the plunger so may not be separate items. Other constructions are also possible.

Preferably the housing includes a base for supporting the housing on a surface and a top surface opposite to the base and wherein the aperture is located in the top surface for manual deposit of the pouch into the holding container through the aperture.

Preferably the solenoids are mounted so as to move the plungers thereof in a generally horizontal direction.

Preferably the holding container has end walls defined by the crusher members.

Preferably the first and the second solenoid each comprises a coil defining a bore and a hollow casing enveloping the coil.

Preferably the plunger further comprises a counterweight formed at an end thereof opposite to the crusher members.

Preferably the plunger further defines a central bore at the end adjacent the crusher member causing a shift in the centre of mass away from the end of the plunger at the crushing member.

Preferably the housing includes two parallel side walls each along a respective side edge of the top wall and wherein the aperture comprises a slot across the top surface and a depending slot portion extending into each side wall of the housing.

Preferably the switch is located in the top surface to one side of the aperture.

Preferably the aperture is in the center of the top surface.

Preferably the holding container has a base wall over which the crusher members pass and arranged to support a bottom edge of the pouch.

Preferably the base wall is arranged such that an upper end of the pouch projects through the aperture for grasping by the fingers of the user when the bottom edge sits on the base wall.

Preferably the holding container has side walls over which the crusher members are arranged to pass with the side walls being located immediately inside the side walls of the housing.

Preferably the power source and the switch are arranged such that the solenoids are repeatedly actuated to provide a repeated crushing action while the switch is maintained actuated.

According to a second aspect of the invention there is provided a pill crusher comprising:

a housing having a base for resting on a surface and a top surface opposite to the base;

a holding container in the housing for one of more pills carried in a pouch;

an aperture slot across the top wall of the housing allowing access into the holding container for manual insertion of the pouch containing the pills into the holding container;

at least one solenoid mounted within the housing longitudinally of the housing and including a plunger mounted for movement longitudinally of the housing;

the plunger carrying a crusher member;

a power source mounted within the housing and a switch actuable by a user for supplying power to the solenoids;

the solenoid being mounted in the housing so as to move the crusher members along the housing for impact with a second crusher member within the holding container;

the crusher member and the second crusher member being arranged at the holding container so as to impact within the holding container and the crusher members having cooperating surfaces arranged to crush the pills in the pouch.

The pill crusher thus includes a housing, wherein a fast and a second solenoid, a holding means, and a power source are disposed within such housing. The housing means defines an aperture for receiving the pharmaceutical pills into the holding means to be pulverized into powder form, The first and the second solenoid are mounted within the housing such that the first and second solenoid opposes each other and the holding means is disposed between the first and the second solenoid. The first and the second solenoid each comprises a coil defining a bore, a hollow casing enveloping the coil and a plunger disposed within the bore of the coil. The plunger further comprises a crushing member formed at a first end and a counterweight formed at a second end. The plunger further defines a central bore at the second end such that much of the magnetic material of the plunger is removed, causing a shift in the centre of mass away from the centre of the plunger and towards the crushing member end of the plunger.

When the power source is activated, the coils of the first and second solenoid are energized. The magnetic force from the coils pulls the plungers towards each other such that the crushing member of the first solenoid collides with the crushing member of the second solenoid. The mass of the plunger and the mass of the counterweight generates sufficient force to pulverize the pill disposed in the holding means into powder form.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EMBODIMENTS OF THE INVENTION

Figure 1:
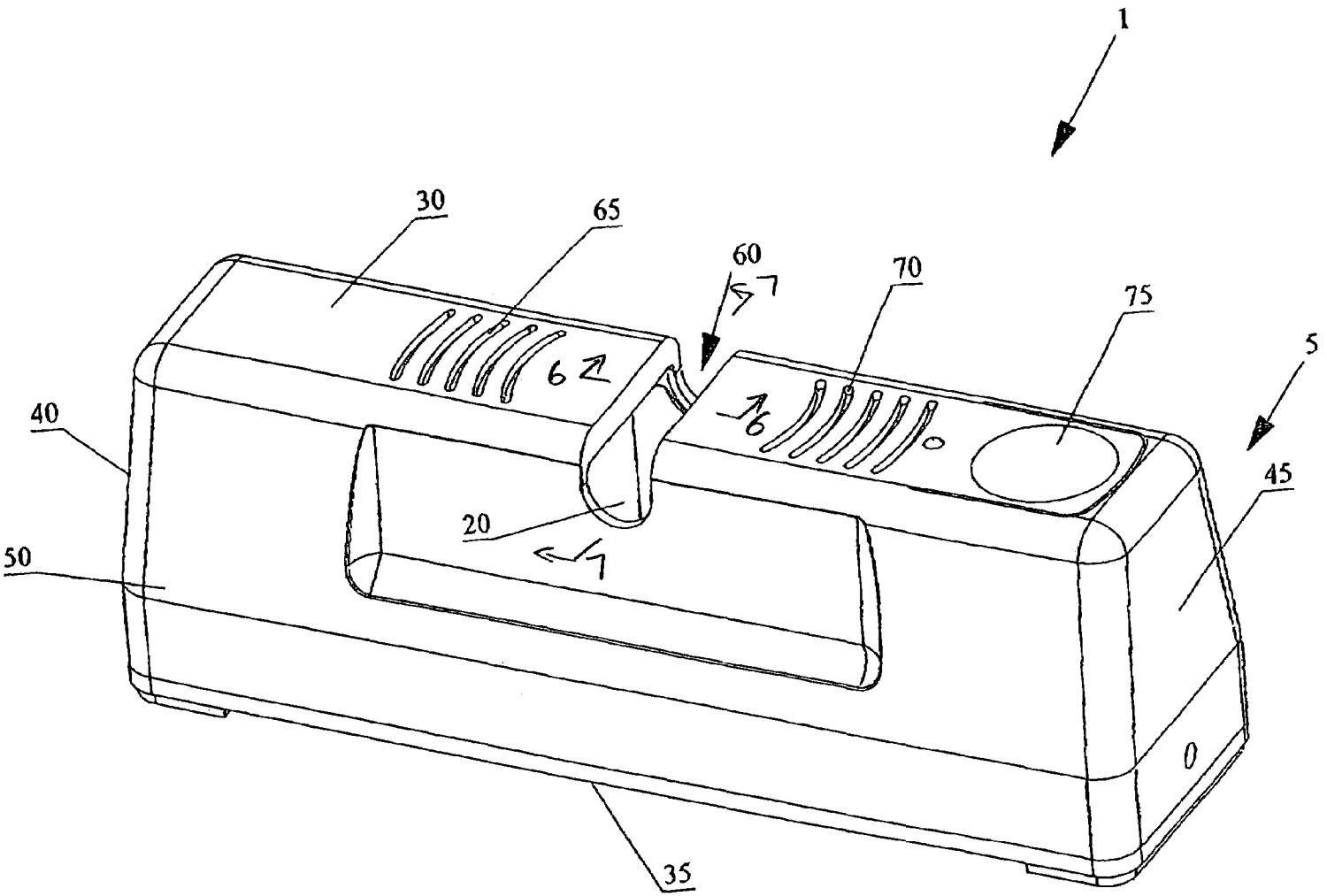
FIG. 1 is a side perspective view of the portable pill crusher according to the present invention.
Figure 2:
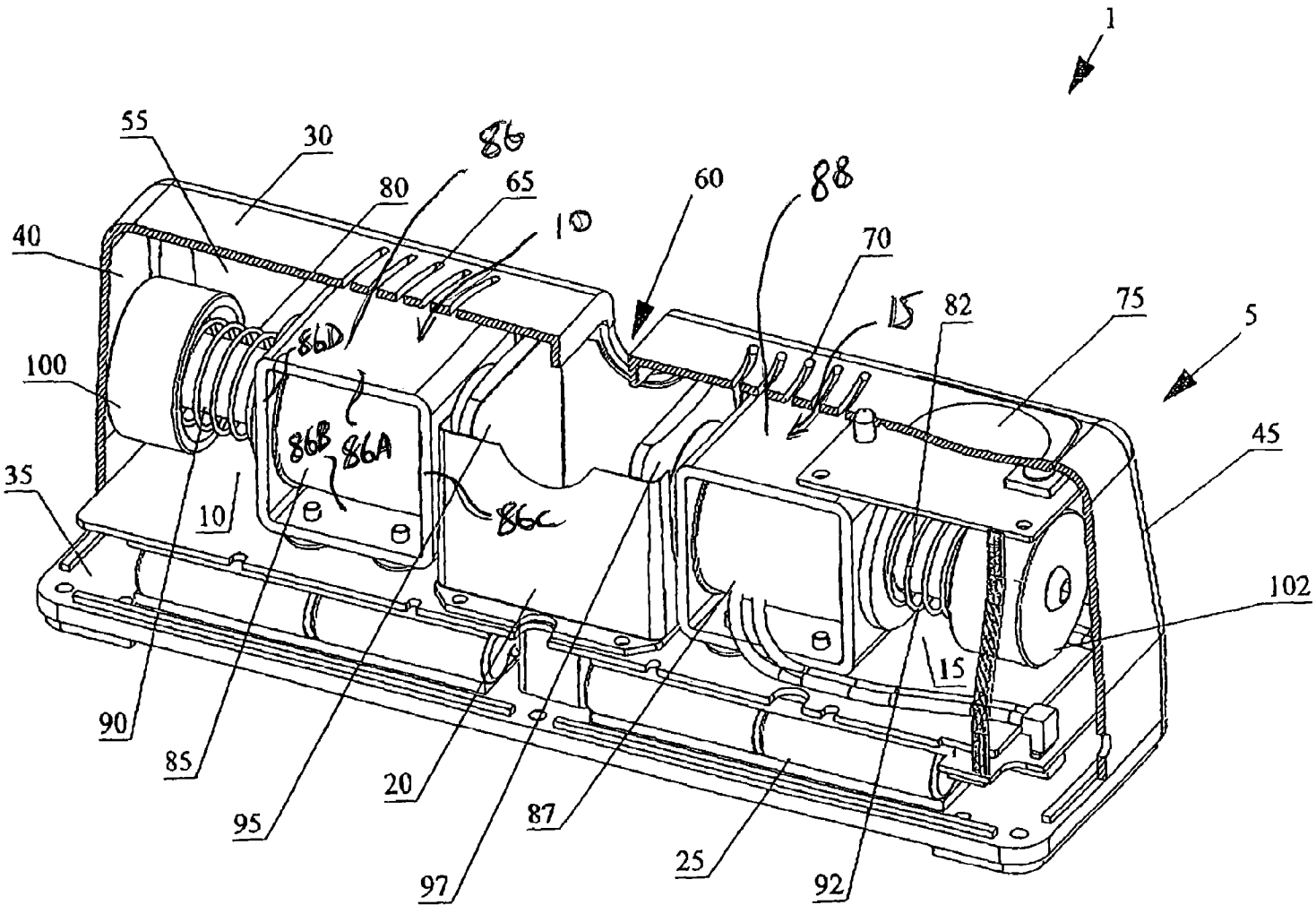
FIG. 2 is an elevated side perspective view of the portable pill crusher shown in FIG. 1.

As seen in FIGS. 1 and 2, the pill crusher 1 comprises a housing 5 wherein a first solenoid 10, a second solenoid 15, a holding container 20, and a power source 25 are disposed within the housing 5.

The housing 5 is preferably made of plastic or any other light weight and durable material and measures in one example 3.5 inches by 3.0 inches by 11.5 inches. The housing 5 is typically a four sided generally rectangular body including a top panel 30 and a base 35 wherein the top panel 30 and base 35 are integrally formed with two parallel side panels 40 and 45 and two parallel front and back panels 50 and 55. The top panel 30 defines an aperture 60 for receiving pharmaceutical pills into the holding container 20. Preferably, the top panel 30 further defines two vents 65 and 70 positioned above the first solenoid 10 and second solenoid 15, respectively. An actuator, such as a depressible button 75, adapted to connect the power source 25 to the solenoids is preferably positioned at the top panel 30. The power source 25, which is located underneath the solenoids within the housing 5 and accessible from the base is preferably a rechargeable battery.

Figure 3:
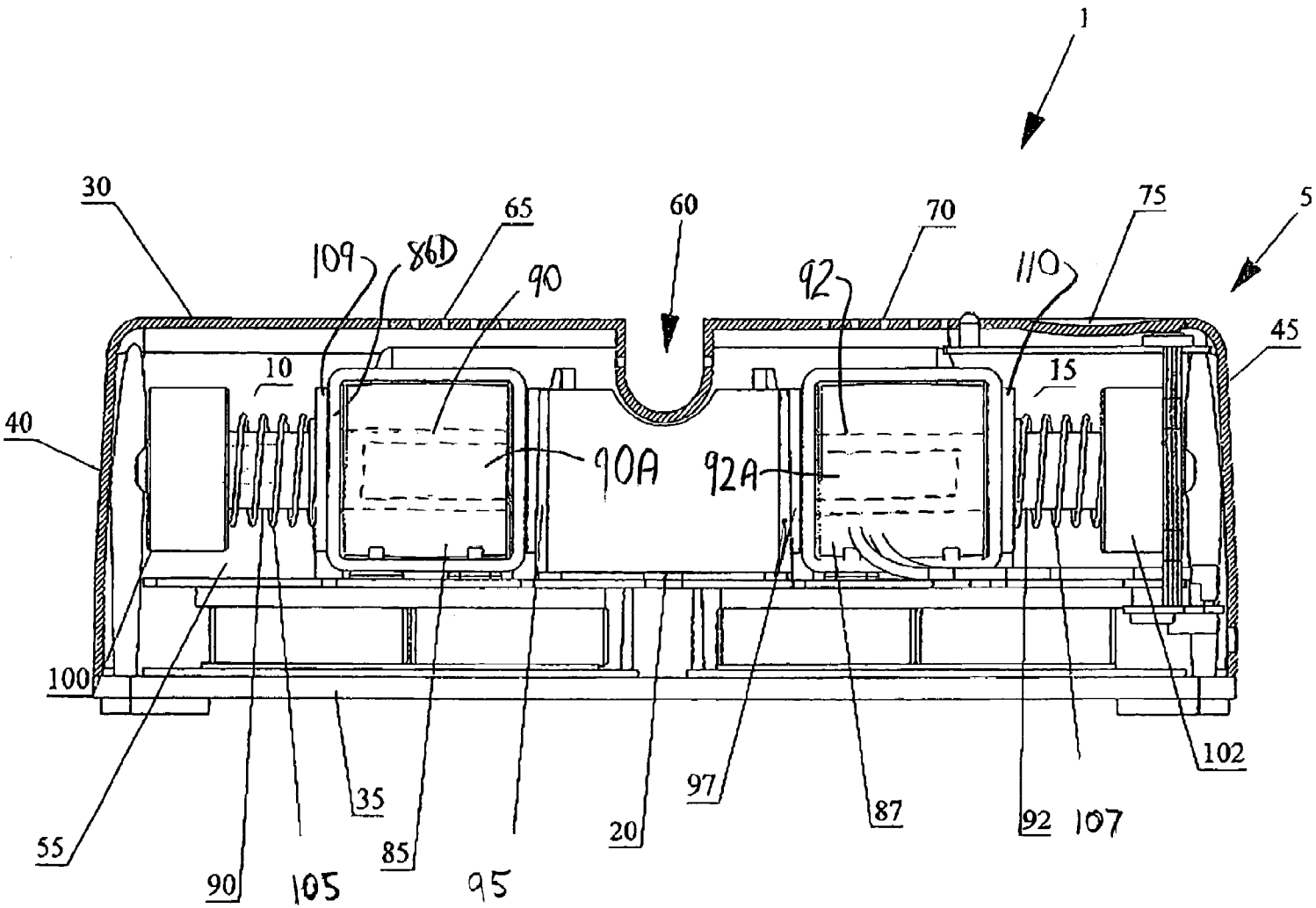
FIG. 3 is an elevated side view of the portable pill crusher 5 shown in FIG. 1.

As shown in FIGS. 2 and 3, the first solenoid 10 and second solenoid 15 are positioned such that first solenoid 10 and second solenoid 15 are mounted for actuation in a horizontal plane in opposite directions so as to oppose each other. The first solenoid 10 and second solenoid 15 are aligned horizontally with the holding container 20 positioned between the first solenoid 10 and second solenoid 15.

Figure 4:
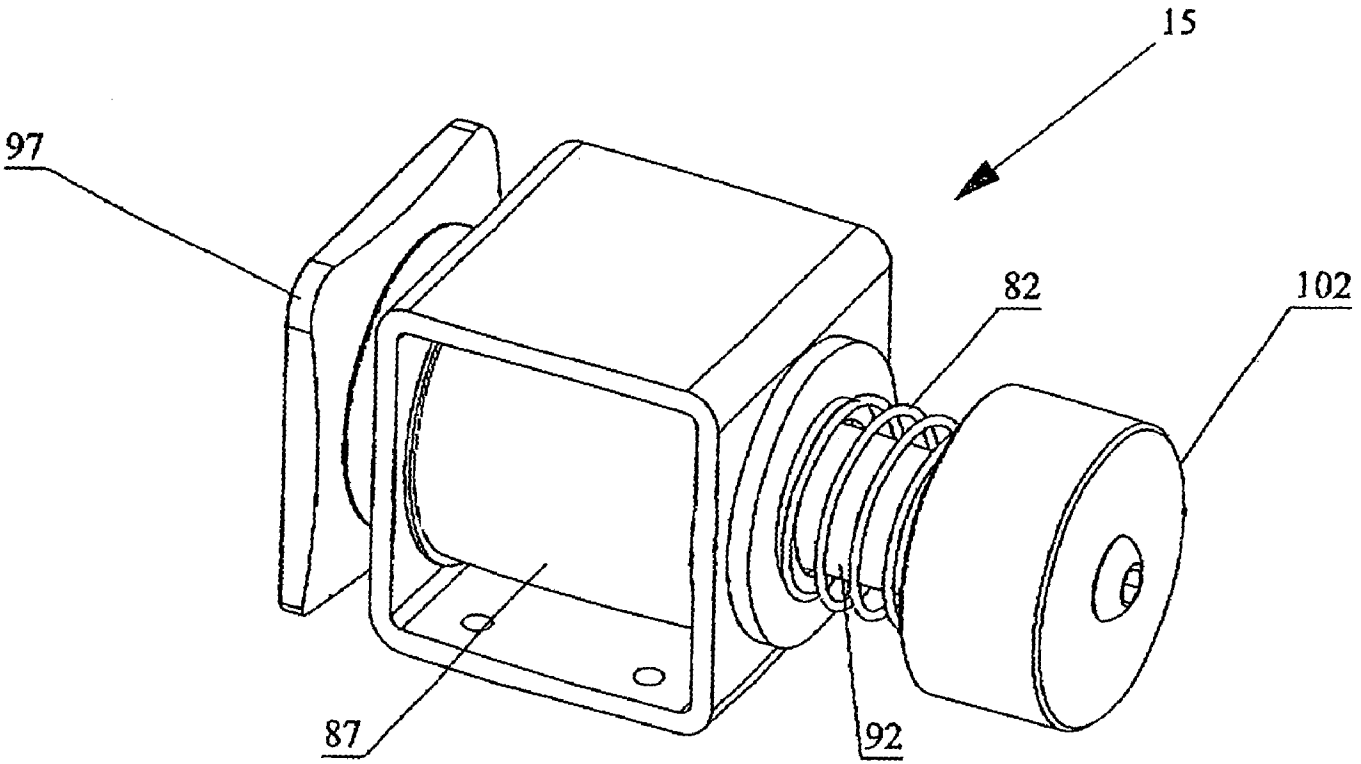
FIG. 4 is a side perspective view of a solenoid disposed within the portable pill crusher shown in FIG. 1.
Figure 5:
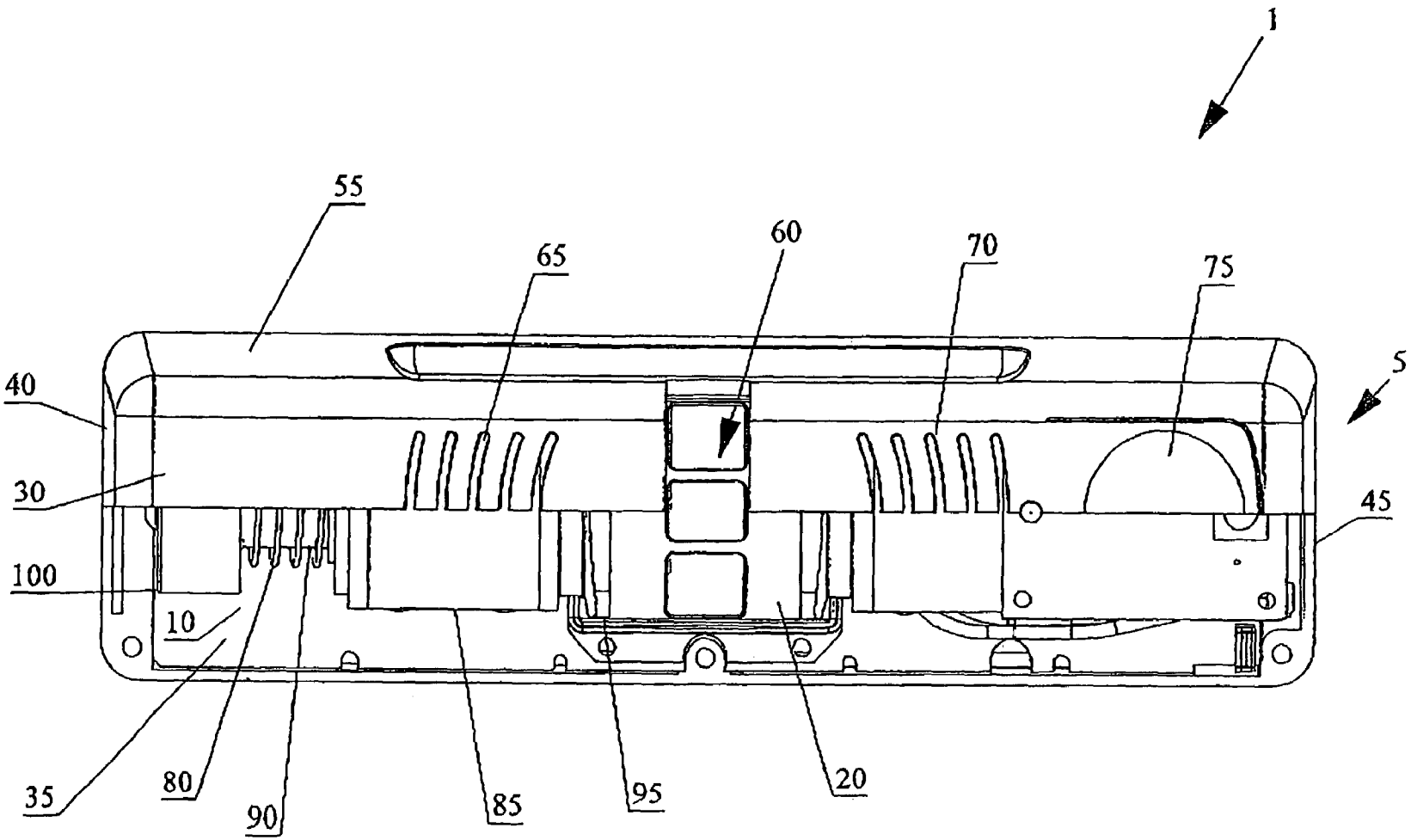
FIG. 5 is a top view of the portable pill crusher shown in FIG. 1.

As shown in FIG. 4, the first solenoid 10 and second solenoid 15 each include an electromagnetic coil 85, 87 located within a hollow casing 86 and 88 which partially envelopes the coils, respectively, and a plunger 90 and 92 disposed within the bore defined by coils 85 and 87, respectively. Each plunger 90 and 92 further carries a crushing plate 95 and 97 formed of a suitable rigid material which may be plastic mounted at a forward end of the plunger 90 and 92, respectively, and an end cap or mass 100 and 102 formed at a rearward end of the plunger 90 and 92, respectively. Typically, the coils 85 and 87 are comprised of copper wire, which creates a magnetic flux when a current flows through such wire. The hollow casings 86 and 88 are generally made of iron or steel or any magnetic material to allow a magnetic flux path to flow more easily and to add more strength to the magnetic flow. The plungers 90 and 92, which have a positive end and a negative end, are typically made of iron or steel but can be made of any magnetic material. The hollow casings 86 and 88 of the first solenoid 10 and the second solenoid 15 are open at both sides so that each includes a top wall 86A, a bottom wall 86B, a forward end wall 86C and a rearward end wall 86D. A spring 105 and 107 is mounted around the plunger 90 arid 92, respectively, to return the plungers back to their respective first positions when coil 85 and 87 are de-energized.

When the coils 85 and 87 are not activated, the plungers 90 and 92 are retained in a first retracted position, as seen in FIGS. 2 and 3 by the springs. When the coils 85 and 87 are energized, the plungers 90 and 92 are driven by the coils 85 and 87 in the forward direction, causing the plunger 90 to accelerate through the coil 85 towards the opposing plunger 92 and the plunger 92 to accelerate through the coil 82 towards the opposing plunger 90 simultaneously such that the crushing plates 95 and 97 collide simultaneously with any material between the crushing plates 95 and 97. Each of the plungers 90 and 92 includes a central longitudinal bore 90A, 92A at the forward end such that much of the magnetic material forming the plunger 90 and 92 is removed at that end, causing a shift in the centre of mass away from the center of the plunger 90 and 92 and away from the crushing plate 95 and 97. In this way, when the solenoid is activated, the iron rod forming the plunger tends to move its center of mass toward the center of the coil forming the solenoid. As the enter of mass is located closer to the end mass, the plunger is accelerated forwardly. The mass of the plungers 90 and 92 together with the mass of the crushing plates 95 and 97 and the mass of the counterweights 100 and 102, create the inertia requited to pulverize the pills when such pills are placed in the holding container 20. The movement of the plungers is limited by engagement of the respective end mass 100, 102 with a respective resilient stop ring 109, 110 carried on the rear end wall 86D of the respective casing. The positions of the end masses relative to the stop rings are arranged such that the crusher plates cannot impact on one another in the absence of intervening material. However the clearance between them is less than the distance necessary to effect a crushing action on pills contained between the crusher plates. In this way, the crusher plates approach sufficiently closely to effect a crushing action even if one is slightly out of time with the other and thus reaches its end stop before the other.

A simple processor is used to control and regulate the current flow from power source 25, in response to actuation of the switch 75, to the coils 85 and 87 to energize the coils when the plunger 90 and 92 are in the first retracted position, and de-energize the coils 85 and 87 when the crushing plates 95 and 97 impact at the forward position of each plunger. By providing a processor to regulate the current flow, the operation of the pill crusher 1 may be maintained at the most energy efficient level.

The pill crusher 1 is operated by placing the pills in a container, such as a plastic pouch, and inserting the pouch through the aperture 60 and into the holding container 20. When the depressible button 75 is manually depressed to connect the power source 25 through the processor to actuate the coils 85 and 87, the coils are energized and cooperate with the plungers 90 and 92 to accelerate the crushing plates 95 and 97 towards each other. The crushing members 95 and 97 accelerate through the holding container 20, striking the pouch containing the pills, thereby pulverizing the pills disposed within the pouch. The collision of the crushing plates 95 and 97, assisted by the mass of the counterweights 100 and 102 generate a force sufficient to pulverize the pills into powder form. The powder form of the medication stays entirely within the pouch, retaining the entire dosage of the pill and eliminating any possibility of cross-contamination.

The pill crusher 1 is intended for use in care facilities to reduce pharmaceutical pills to a powdered form, allowing administration of medication by mixing the powdered form of the medication into food or dissolving in liquid.

Figure 6:
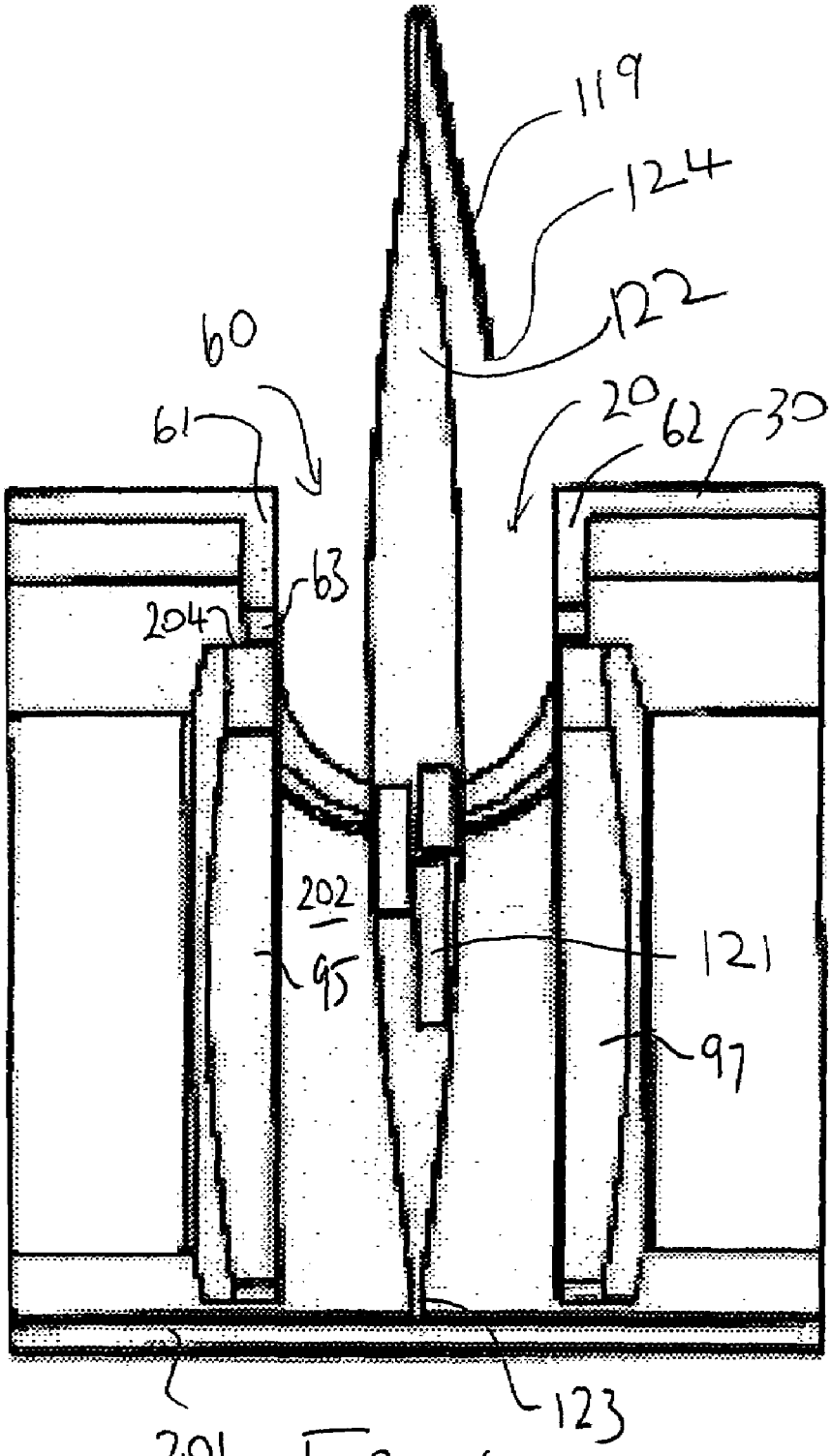
FIG. 6 is a cross-sectional view taken along the lines 6-6 of the pill crusher shown in FIG. 1 including a pouch containing a pill to be crushed.
Figure 7:
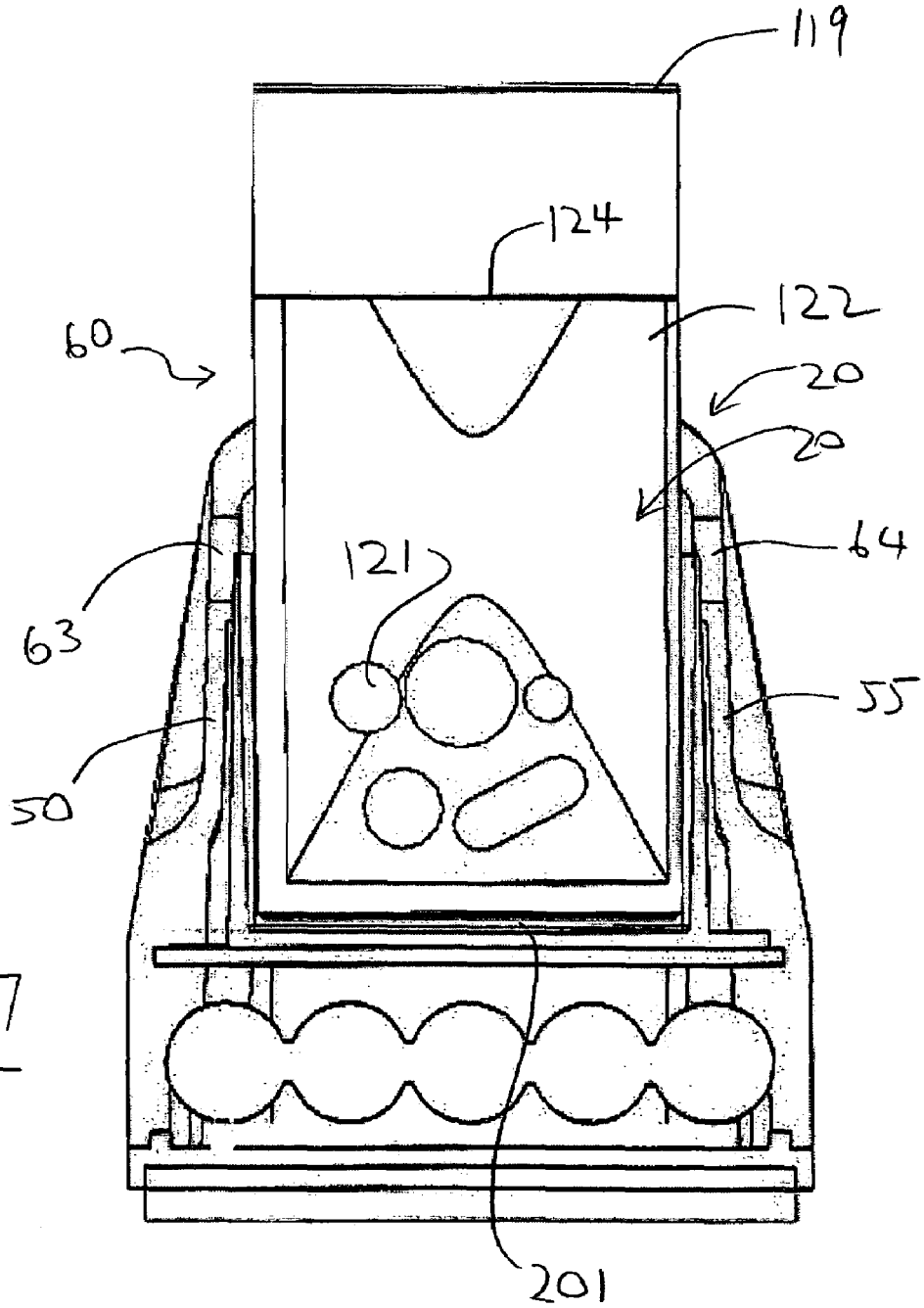
FIG. 7 is a cross-sectional view taken along the lines 7-7 of the pill crusher shown in FIG. 1 including a pouch containing a pill to be crushed.

In FIGS. 6 and 7 is shown the pill crusher in operation. Thus pills 121 are inserted within a pouch 122 which has sealed bottom end 123 and an open mouth 124 at the upper end. The upper end can be folded over as shown at 119 to limit the escape of powder from the crushed medication. The pills are inserted manually by the operator grasping the pouch from a suitable supply. The pouches are intended for one time use and discarded after the pills have been crushed and dispensed into a required situation.

The holding container 20 is mounted inside the housing so as to be slightly inward of the side walls 50 and 60 and below the top wall 30. The holding container 20 is defined by a base wall 201 and two upstanding side walls 202 and 203. Each of the side walls has a top edge 204 spaced below the top wall 30. The crusher plates 95 and 97 are mounted between the side plates 202 and 203 and on top of the base plate 201 so that the crusher plates cooperate with the side plates and the base plate to form the container. The side edges of the crusher plates 95 and 97 are substantially vertical so that they are closely adjacent the inside surface of the side plates 202 and 203 in a sliding action. A bottom edge of each of the crusher plates 95 and 97 slides over the base plate 201. The crusher plates thus define vertical inside flat surfaces which move together into impact in the absence of any pouch and pills between the crusher plates, when the crusher plates are moved by the actuated solenoids.

The aperture 60 is formed by a slot transversely across the top surface 30 and extending across the full width. The slot has two side edges 61 and 62 spaced apart by a distance slightly less than the spacing between the crusher plates when the crusher plates are retracted. The side walls 50 and 60 are formed into a U shaped opening 63 and 64 respectively with the U shaped opening being recessed into the side wall from the edges 61 and 62 of the aperture 60.

Thus the operator can grasp a selected pouch and can feed the pouch downwardly into the aperture 60 with the fingertips until the base 123 of the pouch sits on the base plate 201 leaving the upper edge of the pouch above the top surface 30. The recesses 63 and 64 allow the user to reach into the container if necessary but the width of the slot is sufficiently narrow that the fingertips of the user are restricted from entering the aperture and thus being pinched between the crushing plates when the crushing action occurs.

In operation the user inserts the pouch with the pills at the bottom of the pouch into the container 20 through the aperture 60. When the pouch is in place within the container, the actuating button 75 is depressed causing the processor to actuate the solenoids so that the crushing plates are simultaneously and symmetrically moved inwardly toward one another in a crushing action. This crushing action is repeated relatively quickly so that the two crushing plates tend to tamp together gradually breaking down the pills. The repeated tamping action tends to break down the pills without applying sufficient force to damage the pouch or to crush the materials into the surface of the pouch.

The operator can feel the crushing action occurring since the sound and feel of the action changes as the pills break down into particulate form. Brief experience will show to the operator the amount of time necessary and the change in sound and feel which occur indicating the breakdown of the pills sufficiently to remove any larger particles which would interfere with the material being taken in powder form by the patient.

The use of solenoids to drive the tamping action ensures that the crusher plates can stop at a position prior to meeting with the position being dependant upon the amount of material between the crusher plates. As the force is an electromagnetic force, the crusher plates can stop at any position without damage to any components. Once the electromagnetic force is removed, the spring retracts the plungers of the solenoids for a further tamping movement. The amount of force obtained is insufficient to cause damage to the operator should the fingers become pinched. The breakdown of the pills is effected by the repeated tamping action with the intention that the breakdown of the pills occurs within a period of less than 5 seconds so as to avoid delay to the user.

The device is simple and effective and takes up very little space with the opening for the insertion of the pouch conveniently located at the center of the device. The repeated tamping action using two opposed solenoids allows the operation of the device using rechargeable battery power so that the device is fully portable.

As will be apparent to those skilled in the art in the light of the foregoing disclosure, many alterations and modifications are possible in the practice of this invention without departing from the spirit or scope thereof.

The invention claimed is:

1. A pill crusher comprising:

a housing;

a holding container in the housing for one of more pills carried in a pouch;

an aperture in the housing allowing access into the holding container for insertion of the pouch containing the pills into the holding container;

a first and a second solenoid mounted within the housing;

each solenoid including a plunger carrying a crusher member;

a power source mounted within the housing and a switch actuable by a user for supplying power to the solenoids;

the solenoids being mounted in the housing in opposition so as to move the crusher members toward one another into impact;

the crusher members being arranged at the holding container so as to move into impact within the holding container and the crusher members having cooperating surfaces arranged to crush the pills in the pouch.

2. The pill crusher according to claim 1 wherein the housing includes a base for supporting the housing on a surface and a top wall opposite to the base and wherein the aperture is located in the top wall for manual deposit of the pouch into the holding container through the aperture.

3. The pill crusher according to claim 1 wherein the solenoids are mounted so as to move the plungers thereof in a generally horizontal direction.

4. The pill crusher according to claim 1 wherein the holding container has end walls defined by the crusher members.

5. The pill crusher according to claim 1 wherein the first and the second solenoid each comprises a coil defining a bore and a hollow casing enveloping the coil.

6. The pill crusher according to claim 1 wherein the plunger further comprises a counterweight formed at an end thereof opposite to the crusher members.

7. The pill crusher according to claim 1 wherein the plunger further defines a central bore at the end adjacent the crusher member causing a shift in the centre of mass away from the end of the plunger at the crushing member.

8. The pill crusher according to claim 1 wherein the housing includes a base for supporting the housing on a surface, a top wall opposite to the base and two parallel side walls each along a respective side edge of the top wall and wherein the aperture comprises a slot across the top wall and a depending slot portion extending into each side wall of the housing, the aperture being arranged to allow access into the holding container for manual insertion of the pouch containing the pills into the holding container and for manual removal of the pouch from the holding container after the pills are crushed.

9. The pill crusher according to claim 8 wherein the holding container has side walls over which the crusher members are arranged to pass with the side walls being located immediately inside the side walls of the housing.

10. The pill crusher according to claim 1 wherein the housing includes a base for supporting the housing on a surface and a top wall opposite to the base and wherein the aperture is located in the top wall for manual deposit of the pouch into the holding container through the aperture and wherein the switch is located in the top wall to one side of the aperture.

11. The pill crusher according to claim 1 wherein the housing includes a base for supporting the housing on a surface and a top wall opposite to the base and wherein the aperture is located in the top wall for manual deposit of the pouch into the holding container through the aperture and wherein the aperture is in the center of the top wall.

12. The pill crusher according to claim 1 wherein the holding container has a base wall over which the crusher members pass and arranged to support a bottom edge of the pouch.

13. The pill crusher according to claim 12 wherein the base wall is arranged such that an upper end of the pouch projects through the aperture for grasping by the fingers of the user when the bottom edge sits on the base wall.

14. The pill crusher according to claim 1 wherein the power source and the switch are arranged such that the solenoids are repeatedly actuated to provide a repeated crushing action while the switch is maintained actuated.

15. A pill crusher comprising:

a housing having a base for resting on a surface and a top wall opposite to the base;

a holding container in the housing for one of more pills carried in a pouch;

an aperture slot across the top wall of the housing arranged to allow access into the holding container for manual insertion of the pouch containing the pills into the holding container and for manual removal of the pouch from the holding container after the pills are crushed;

at least one solenoid mounted within the housing longitudinally of the housing and including a plunger mounted for movement longitudinally of the housing;

the plunger carrying a crusher member;

a power source mounted within the housing and a switch actuable by a user for supplying power to said at least one solenoid;

said at least one solenoid being mounted in the housing so as to move the crusher member on the plunger thereof along the housing for impact with a second crusher member within the holding container;

the crusher member and the second crusher member being arranged at the holding container so as to impact within the holding container and the crusher members having cooperating surfaces arranged to crush the pills in the pouch.

16. The pill crusher according to claim 15 wherein the plunger further comprises a counterweight formed at an end thereof opposite to the crusher members.

17. The pill crusher according to claim 15 wherein the switch is located in the top wall.

18. The pill crusher according to claim 15 wherein the holding container has a base wall over which the crusher member passes and arranged to support a bottom edge of the pouch.

19. The pill crusher according to claim 18 wherein the base wall is arranged such that an upper end of the pouch projects through the aperture for grasping by the fingers of the user when the bottom edge sits on the base wall.

20. The pill crusher according to claim 15 wherein the power source and the switch are arranged such that the at least one solenoid is repeatedly actuated to provide a repeated crushing action while the switch is maintained actuated.

21. A pill crusher comprising:

a housing having a base for resting on a surface, a top wall opposite to the base and two parallel side walls each along a respective side edge of the top wall;

a holding container in the housing for one of more pills carried in a pouch;

an aperture arranged to allow access into the holding container for manual insertion of the pouch containing the pills into the holding container and for manual removal of the pouch from the holding container after the pills are crushed;

at least one solenoid mounted within the housing longitudinally of the housing and including a plunger mounted for movement longitudinally of the housing;

the plunger carrying a crusher member;

a power source mounted within the housing and a switch actuable by a user for supplying power to said at least one solenoid;

said at least one solenoid being mounted in the housing so as to move the crusher member on the plunger thereof along the housing for impact with a second crusher member within the holding container;

the crusher member and the second crusher member being arranged at the holding container so as to impact within the holding container and the crusher members having cooperating surfaces arranged to crush the pills in the pouch;

wherein the aperture comprises a slot across the top wall and a depending slot portion extending into each side wall of the housing.

22. The pill crusher according to claim 21 wherein the holding container has side walls over which the crusher members are arranged to pass with the side walls being located immediately inside the side walls of the housing.

* * * * *